United States Patent [19]

Kirschner

[11] Patent Number: 4,836,437

[45] Date of Patent: Jun. 6, 1989

[54] TOY PACKAGING

[75] Inventor: Ann S. Kirschner, St. Louis, Mo.

[73] Assignee: Surprises, Inc., St. Louis, Mo.

[21] Appl. No.: 126,197

[22] Filed: Feb. 16, 1988

[51] Int. Cl.[4] ..... B65D 75/02

[52] U.S. Cl. ..... 229/8; 53/443; 53/445; 206/457; 229/922; 229/923; 446/475; D21/240

[58] Field of Search ..... 229/8, 87 R, 922, 923; 206/457, 495, 526, 822; 446/5, 475; D21/59, 240; 53/443, 445

[56] References Cited

U.S. PATENT DOCUMENTS 3,217,874 11/1965 Potter ..... 206/45.33
3,217,962 11/1965 Weiss ..... 206/45.33

FOREIGN PATENT DOCUMENTS 2611605 9/1977 Fed. Rep. of Germany ..... 446/475
341784 1/1931 United Kingdom ..... 446/475

OTHER PUBLICATIONS

"Decorative Pinatas", from Taylor-Almark Products, Inc., 3-10-76.
Newspaper article from Evening Star, p. A6, 12-26-63.
"Surprise Ball", and Treasure Tube from textbook reference, exact date and author unknown.

*Primary Examiner*—Stephen Marcus
*Assistant Examiner*—Gary E. Elkins
*Attorney, Agent, or Firm*—Neal Kalishman

[57] ABSTRACT

A method and article for providing toy packaging. A number of shaped units are formed by winding strips of material about shaped objects. The shaped objects are combined to form a final package, such as, a train.

5 Claims, 3 Drawing Sheets

TOY PACKAGING

BACKGROUND OF THE INVENTION

1. Field of the Invention

The present invention is directed to a method of packaging toy products. In particular, the invention teaches a method of packaging multiple toys in a paper wrapping that allows the outer appearance to form a predetermined shape.

2. Description of the Prior Art

A traditional method of wrapping small toys for children is to wind strips of paper about a center core. The toys are placed at various levels during the winding process. As the child reverses the winding process it receives the toy gifts at each of the levels. The receipt of the toys coupled with the unwinding of the paper roll has proven to delight children.

A common feature of these paper balls is that they are based on wrapping around a circular center core. The core is usually formed by wadding tissue paper. These paper balls in the end assure a circular shape.

The present invention is advantageous since it provides a means of forming wrapped toy packages in various shapes. The invention is also advantageous since it is economical and aesthetically pleasing.

SUMMARY OF THE INVENTION

A method of packaging toys which comprises winding strips of material and toys around a shaped object. The winding is continued until a predetermined shape is formed. At least two such shapes may be combined to form a final shape.

DESCRIPTION OF THE PREFERRED EMBODIMENTS

Figure 2:
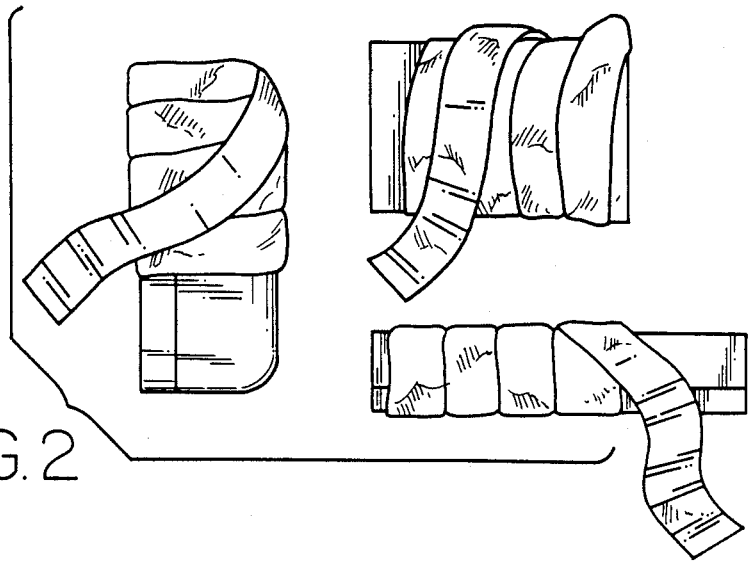
FIG. 2 illustrates the wrapping of the toys of FIG. 1.
Figure 5:
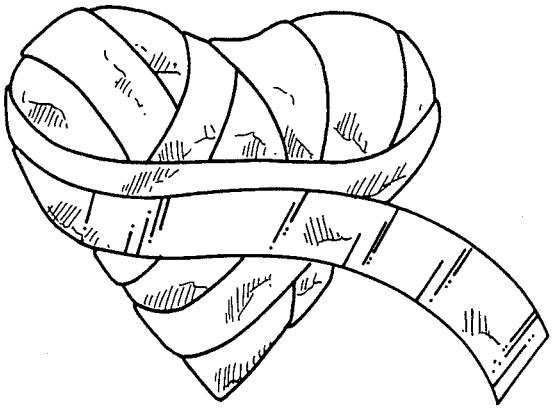
FIG. 5 illustrates a partially wrapped heart shape.
Figure 8:
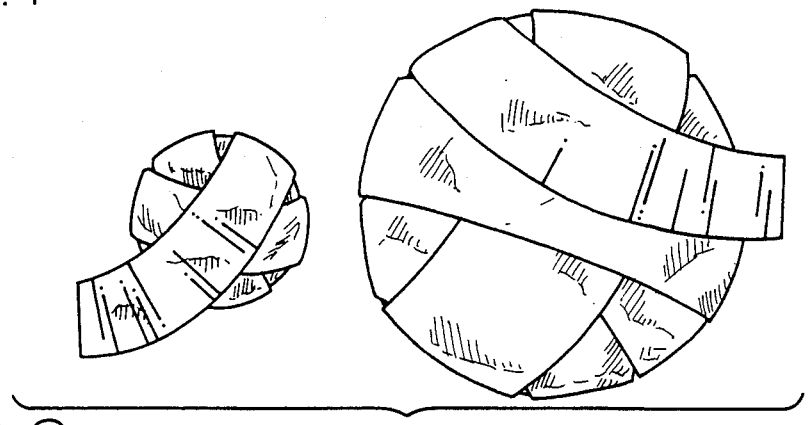
FIG. 8 illustrates the wrapping of the toys of FIG. 7.

As shown in FIGS. 2, 5 and 8, the packages are formed by winding material strips around an object. The initial object can be either a toy or a plastic or cardboard shape. The shapes match the final shape of the package.

The material strips can be a single continuous strip or a number of different strips. Different colored strips can be used to form the various levels of the package. The strips are preferably paper, however, cloth, foil etc. can be used as the winding material.

The positioning of the toys in the package can be determinative of the package's ultimate shape. In most cases it is preferable to incorporate the smallest and especially the thinnest toy into the package last.

More than one package can be affixed together to form a shape. Usually, several shapes are connected to form such objects as a caterpillar, train or a snowman. Adhesives, pins, staples, wires, shrink wrap or other fasteners can be used to affix the packages.

Decorative designs can be bonded to the packages or, if shrink wrap is used outside, to the shrink wrap if so desired. Examples of such decorative applications include paper, cloths, fabrics, plastics, hats, hair-like substances, buttons, sequences, labels, etc.

Figure 1:
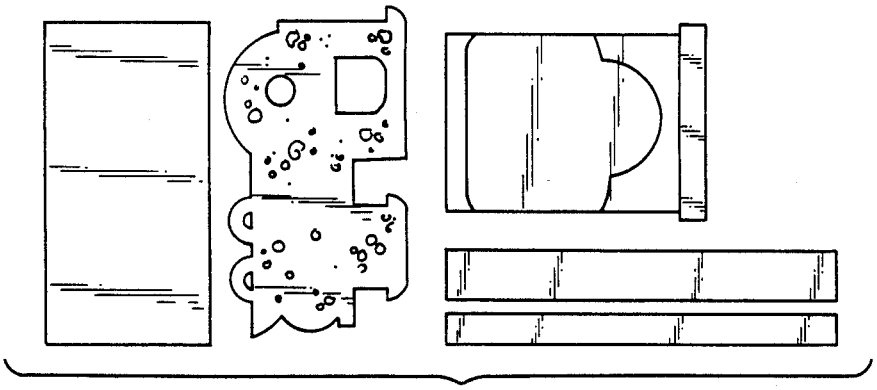
FIG. 1 illustrates a set of toys which can be utilized in the present invention.
Figure 3:
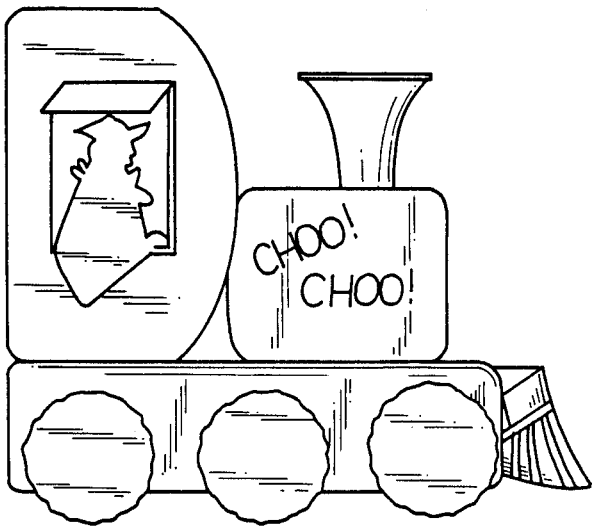
FIG. 3 illustrates the combining of the wrapped toys of FIG. 2 to form a train shape.

FIGS. 1–3 illustrate the forming of a train. Individual toys are wrapped separately to form the train components.

Figure 4:
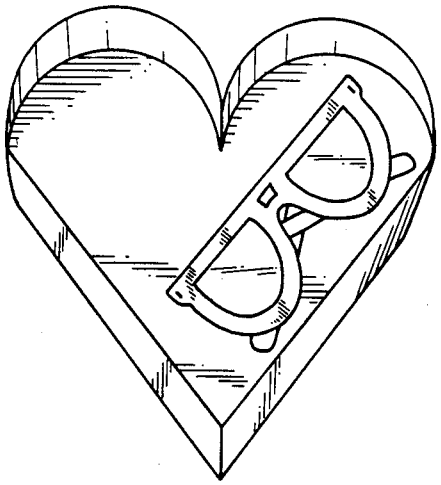
FIG. 4 illustrates a heart shaped container containing a toy.
Figure 6:
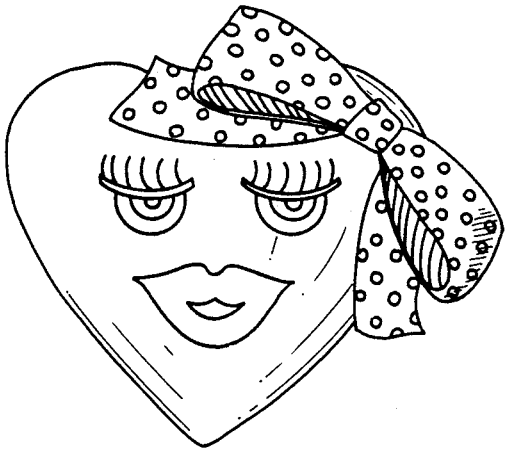
FIG. 6 illustrates a completely decorated heart shape of the invention.

FIGS. 4–6 illustrate the forming of a decorative heart. The toys are first placed in a cardboard shape. The cardboard shape is that of the final product.

Figure 7:
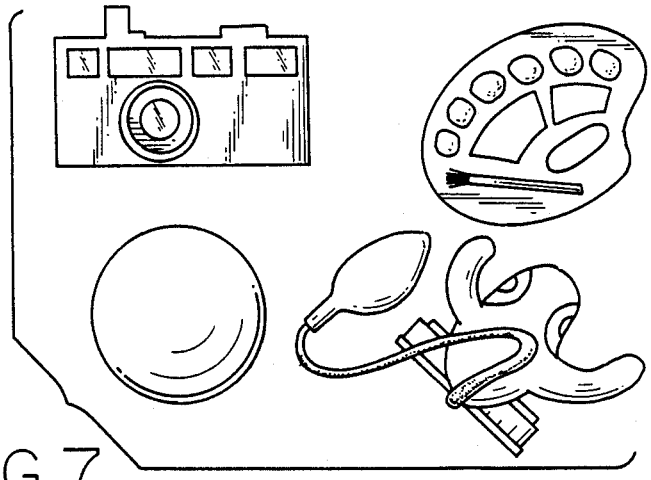
FIG. 7 illustrates a set of toys which can be utilized in the present invention.
Figure 9:
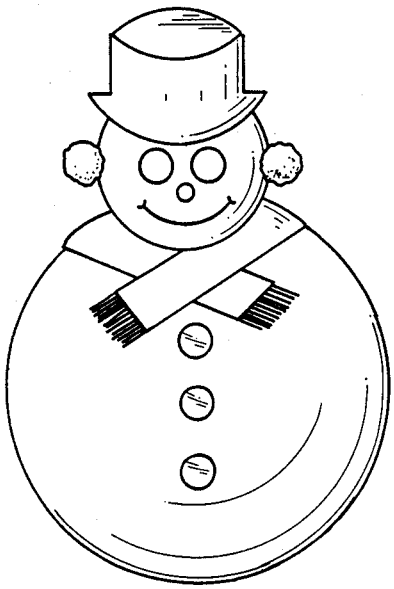
FIG. 9 illustrates the forming of a snowman from the shapes of FIG. 8.

FIGS. 7–9 illustrate the forming of a snowman. The snowman makes use of conventional round shapes to form a unique decorative product.

I claim:

1. A simulated article comprising two or more units where at least some of the units have strips of material wound around a central core and have additional objects located between layers of said strips of material.

2. The simulated article of claim 1 wherein said units further contain decorative materials on surfaces of said units.

3. A method of packaging objects which comprises:

(a) winding strips of material around a shaped object;

(b) adding additional objects between layers of said material;

(c) continuing said winding until a predetermined unit is formed; and (d) combining at least two of said units to form a simulated article.

4. The method of claim 3 wherein said additional objects is a toy.

5. The method of claim 3 wherein decorative materials are applied to said units.

* * * * *